United States Patent [19]

Nelson et al.

[11] 4,395,713

[45] Jul. 26, 1983

[54] TRANSIT ANTENNA

[75] Inventors: Thomas E. Nelson, Thompson; Herbert A. Consor, Chagrin Falls, both of Ohio

[73] Assignee: Antenna, Incorporated, Cleveland, Ohio

[21] Appl. No.: 321,556

[22] Filed: Nov. 16, 1981

Related U.S. Application Data

[63] Continuation of Ser. No. 147,216, May 6, 1980, abandoned.

[51] Int. Cl.[3] ..... H01Q 1/32

[52] U.S. Cl. ..... 343/713; 343/847

[58] Field of Search ..... 343/711–715, 343/850, 846, 847, 700 MS, 860, 861, 705–708, 895, 752, 748

[56] References Cited

U.S. PATENT DOCUMENTS

| | | | |
|---|---|---|---|
| 3,680,127 | 7/1972 | Richard | 343/708 |
| 3,906,507 | 9/1975 | Allen, Jr. | 343/846 |
| 4,072,952 | 2/1978 | Demko | 343/708 |

FOREIGN PATENT DOCUMENTS

| | | | |
|---|---|---|---|
| 2911885 | 10/1979 | Fed. Rep. of Germany | 343/713 |

*Primary Examiner*—David K. Moore

*Attorney, Agent, or Firm*—Watts, Hoffmann, Fisher & Heinke Co.

[57] ABSTRACT

A transit antenna in which a grounded base is provided. A housing is mounted on the base. The chamber and base define a chamber. A substrate is fixed to the base. The housing and substrate have interconnected surfaces to maintain the substrate in substantially fixed orientation with respect to the base. Capacitively coupled antenna layers are in opposite faces of the substrate.

6 Claims, 11 Drawing Figures

TRANSIT ANTENNA

This is a continuation of application Ser. No. 147,216 filed May 6, 1980 and now abandoned.

DESCRIPTION

Technical Field

This invention relates generally to an improved antenna and more particularly to a vehicle mounted antenna capacitively coupled to radio sending and receiving equipment.

Background Art

The design of an antenna is constrained by the frequency of electromagnetic radiation which the antenna is to either transmit or receive. For optimum power transmittal or receipt it is necessary that the physical dimension of the antenna be such that the antenna is resonant to the radiation being transferred.

The art of designing, sending and receiving antennas for moving vehicles must deal with certain constraints not presented in antenna design for stationary base stations. For stationary base stations it is possible to design an antenna which is of a length equal to the wavelength radiation to be transmitted. When this length antenna is chosen it will be resonant with the electromagnetic radiation and therefore be an efficient transmitter and/or receiver.

When an antenna is to be mounted on a moving vehicle, however, it is typically unfeasible to design an antenna of a length equal to the wavelength of radiation to be sent or received. To shorten the length of the antenna, so-called one-half and one-quarter wavelength antennas have been designed and used with success. Although less efficient than full wavelength antennas, these antennas are efficient enough for sending and receiving radio communications over relatively short distances and allows them to be mounted on moving vehicles.

Another advance in the mobile unit antenna art includes the use of so-called loading coils which are inductors series coupled to the antenna. A loading coil series coupled to a short length antenna causes the antenna to resonate at the same frequency as a longer antenna without a loading coil. The use of such loading coils has shortened the physical dimension of vehicle mounted antennas to the point where they can be conveniently mounted on most sized vehicles.

Unusually large vehicles such as buses, fire and ambulance equipment, however, may be so large that even coil loaded antennas become damaged by overhanging obstructions such as trees, bridges, or storage garages. Fortunately, these large vehicles may employ commercial communication systems which operate at high radio frequencies. Commercial communications systems utilizing transceivers in the 400–500 megahertz range, for example, operate with quarter wavelength antennas approximately one-half foot long. Such antennas have been used with success on commercial vehicles to avoid contact with overhanging objects.

While short length commercial frequency antennas are known, problems have been experienced using prior art designs of such antennas. One problem experienced is in impedance matching the short antennas to conventional lead in cable to the communications transceiver. Once the physical length of the antenna has been chosen for a particular frequency of operation the impedance this antenna presents to signals is fixed and may not match the impedance of the lead in cabling to the transceiver. This problem of mismatching of impedances between antenna and cabling is made more complex when a variable length antenna resonant at different frequencies is employed.

One solution to the impedance mismatch problem is to capacitively couple the antenna to the lead in cable. This technique is particularly effective where a load coil is used since the capacitive impedance of the capacitor will counteract the inductive impedance of the inductor to present a predominantly resistive impedance to radio signals.

When a variable length antenna is used to tune the antenna for different sending and receiving frequencies, however, a variable capacitance must couple the antenna to the lead in cable. One prior art technique for tuning the antenna to different frequencies was to insert a screw into the end of the antenna which could be screwed in and out to change the antenna length. When this so called wand antenna was connected to coaxial cable the center conductor of the cable was capacitively coupled to the antenna length with a variable capacitance. This capacitance was formed by mounting a movable insulating sheath about a post which extended away from the center conductor so the combination of the antenna, sheath and post formed a capacitor. By physically adjusting the screw setting, the distance between the post and antenna, and capacitive sheath position on the post, it was possible to both tune the antenna for a particular frequency and match the impedance to the cable.

While this prior art technique for tuning and impedance matching an antenna was sound in theory, in practice, road vibrations transmitted from the vehicle to the antenna soon mistuned the antenna. The attempt to provide a variable frequency sending and receiving capacity resulted in less efficient radio communication. Since these short length mobile antennas are typically used in applications where reliability is a must, such variability in operating conditions was unacceptable.

DISCLOSURE OF INVENTION

The present invention comprises an antenna which overcomes the reliability problems experienced in the prior art. It is of a rugged and efficient design particularly suited for professional communications which use high frequency radio signals. Vehicle vibration changes neither the effective length of the antenna nor the impedance coupling between the antenna and the lead in cabling to the communications transceiver. Since the antenna is designed for high frequency transceiving it is short enough to be mounted to even large vehicles without coming in contact with overhanging objects or structures.

According to the invention, the antenna is mounted to an insulating substrate such as a plastic printed circuit board and is constructed in the form of a conductive radiating and receiving surface which adheres to the substrate. In the preferred embodiment a capacitor for impedance matching the antenna to the transceiver is formed from two conductive surfaces on opposed sides of the substrate. One of the capacitive surfaces is coupled to the antenna and the second is coupled to lead in cable connected to a transceiver mounted inside in vehicle.

The signal sending and receiving surface is resonant to a particular wavelength radiation and does not change its configuration with vehicle vibration. Since the physical dimension of the radiation transmitting surface is fixed in length, the capacitor surfaces which couples the antenna to the lead in cable are also fixed in size.

This design significantly enhances antenna reliability. By slightly altering the size of the radiation transmitting surface the antenna may be precisely tuned to reasonate at a particular frequency. Vibration will not mistune the antenna since once the size of the surfaces are optimized there are no adjustable or moving components.

The antenna substrate is mounted to a conductive plate which is grounded to the vehicle. One end of the antenna is grounded while the capacitive surface coupled to the antenna is tapped from the antenna at a point removed from ground. When 50 ohm cable is used to connect the transceiver to the antenna this tap point is chosen to be 50 ohms removed from ground.

A housing made from a material transparent to radio frequency electromagnetic radiation is positioned over the substrate and attached to the mounting plate to protect the antenna from the environment. The housing defines a slot which receives the substrate to inhibit substrate vibration.

According to the preferred embodiment of the invention the antenna mounting substrate is longer than it is wide and is mounted in an orientation perpendicular to the conductive plate. The radiation sending and receiving surface is L-shaped and extends out away from the mounting ground plate and then along the substrate length in a direction parallel to the surface defined by the ground plate. The antenna's L-shaped surface length is chosen to resonate at a particular frequency. For radio signals in the 400–500 megahertz range the surface is approximately one-half foot long. One end of this surface is coupled to the ground plate by suitable connectors which serve the dual function of supporting the substrate and providing electrical communication between the ground plate and the antenna.

Improved antenna performance is achieved when a radiating L-shaped surface is affixed to both sides of the insulating substrate. Although not physically coupled along their length the two surfaces are capacitively coupled through the substrate. Use of two radiating surfaces attached to a common substrate increases the antenna's bandwidth and provides more surface area for greater power dissipation.

From the above it is apparent that one object of the present invention is the provision of a reliable, compactly designed antenna which is especially adapted for mobile communications and which remains tuned during use. Other objects and features of the invention will become better understood when a detailed description of the preferred antenna is considered in conjunction with the accompanying drawings.

BEST MODE FOR CARRYING OUT THE INVENTION

Figure 1:
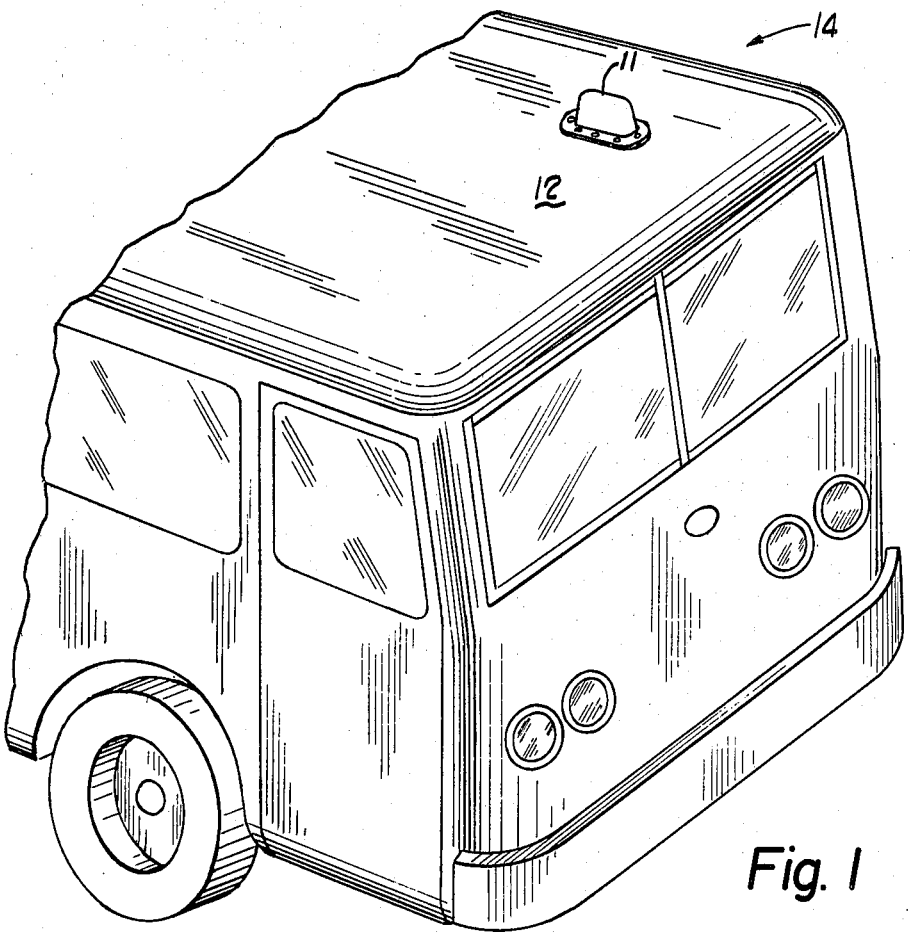
FIG. 1 shows a bus with an antenna mounted to its roof.
Figure 2:
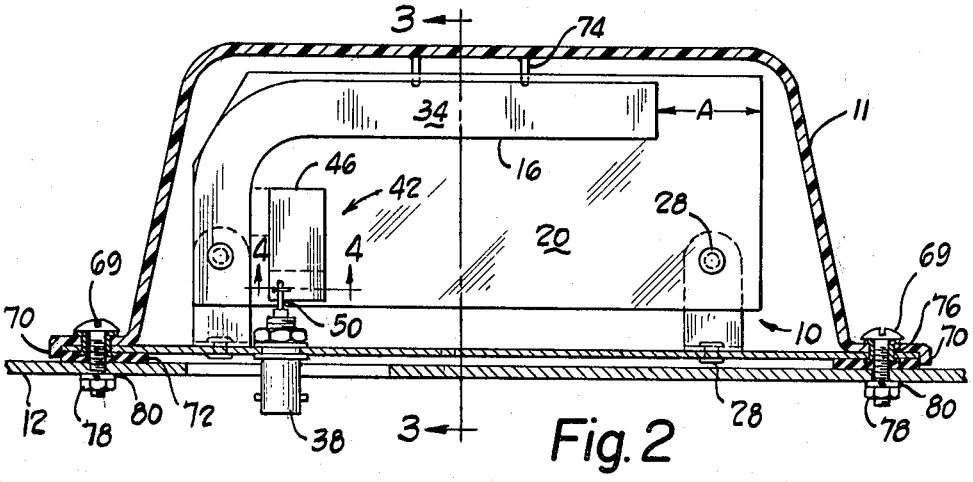
FIG. 2 is an elevational view of an antenna constructed in accordance with the present invention coupled to a conventional BNC connector.

Turning now to the drawings and in particular FIGS. 1 and 2, there are shown an antenna 10 and antenna housing 11 connected to a top surface 12 of a bus 14. The disclosed antenna is particularly suited for large mobile vehicles which due to their height present problems in antenna design. As seen in FIG. 1, the disclosed antenna is of a compact design which extends only a few inches above the surface 12. This type antenna is less likely to come in contact with, and is less susceptable to damage in the event of contact with overhanging objects in the path of the vehicle than are known wand antennas.

The disclosed antenna 10 is constructed to resonate at a particular frequency. The nonadjustability of the antenna allows for a more rugged construction so that the resonant frequency of the antenna does not change with vehicle vibration. According to the disclosed and preferred embodiment the antenna comprises two conducting L-shaped surfaces 16, 18 mounted to an insulating substrate 20. The substrate 20 comprises a conventional glass epoxy printed circuit board material which is approximately 1/16 inch thick. The surfaces 16, 18 comprise copper foil which has been affixed to the substrate by conventional printed circuit board design technique. The conductive surfaces are affixed to opposite sides to the substrate 20 and due to capacitive coupling through the substrate present an essentially continuous conducting media for both receiving and sending high frequency radio signals.

Figure 5:
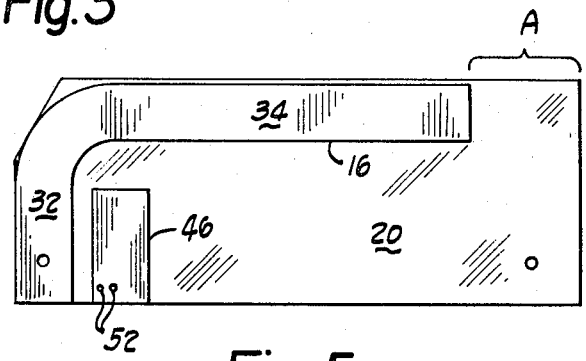
FIGS. 5 and 6 show opposed surfaces of the antenna shown in FIG. 2.
Figure 6:
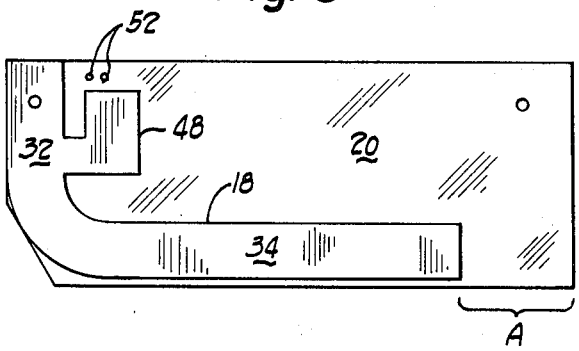

The substrate 20 is mounted to a conductive plate 22 by two L-shaped brackets 24, 26 which are connected to the plate 22 and substrate 20 by rivets 28. The plate 22 is grounded to the bus surface 12. The substrate 20 is maintained in an orientation substantially perpendicular to the plate 22 so that each L-shaped surface 16, 18 has a short portion 32 extending away from the plate and a longer portion 34 extending in a direction parallel to the plate. The opposite sides of the substrate 20 are shown in FIGS. 5 and 6 respectively.

Figure 11:
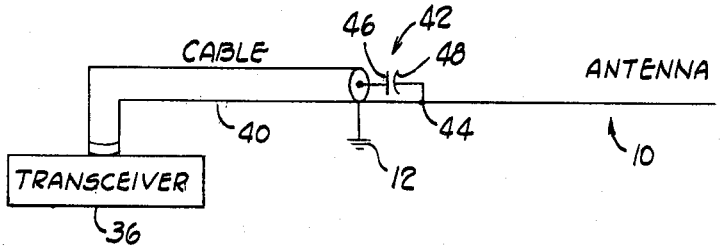
FIG. 11 is a schematic diagram of a conventional antenna coupled to a transceiver for sending and receiving high frequency signals.

Electrical communication between the conducting surfaces 16, 18 and a transceiver 36 (FIG. 11) mounted inside the bus is through a conventional BNC connector 38 supported by the plate 22. An outside surface of the BNC connector is in electrical communication with the conducting surfaces 16, 18 through the plate 22 and one of the two L-shaped brackets 24. When a conventional coaxial cable 40 is coupled to the BNC connector 38 it should be appreciated that the conducting surfaces 16, 18 are electrically coupled to the outside conducting sheath of the coaxial cable as seen in the schematic illustration of a typical antenna shown in FIG. 11.

To enhance impedance matching between the cable 40 and the antenna conducting surfaces 16, 18 a capacitor 42 has been shown schematically inserted between a center conductor 41 of the cable 40 and a tap point 44 on the antenna. For conventional 50 ohm cable the impedance between the base or grounded portion of the antenna and the tap point is chosen to be 50 ohms to match the antenna to the cable.

Returning now to FIG. 2, the capacitor 42 comprises two conductive surfaces 46, 48 which are affixed to the substrate 20 in a manner identical to the mounting technique for the conductive surfaces 16, 18. In combination the two surfaces 46, 48 and the substrate 20 comprise a capacitor for capacitively coupling a center contact 50 on the BNC connector 38 to a tap point 52 on the conducting surface 18.

Figure 4:
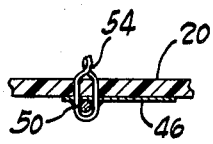
FIG. 4 is an enlarged and fragmentary cross sectional view of an electrical connection between the antenna and a connector taken along the line 4—4 in FIG. 2.

The mechanism for connecting the contact 50 to the surface 46 is shown in FIG. 4. Two holes 52 are drilled through the substrate 20 on opposite sides of the center contact 50. A conductive wire 54 is wound about the contact 50 and through the holes drilled into the substrate. The wire 54 is the soldered to insure electrical coupling between the contact 50 and the conductive surface 46. The wire 54 strengthens the electrical connection between the contact 50 and the surface 46.

By changing the physical dimension of the copper conducting surfaces 16, 18 the resonant frequency of the antenna 10 can be changed. For resonant frequencies in the 406–512 megahertz range the preferred substrate 20 is 2" wide and 5-1/16" long. Each of the conducting surfaces 16, 18 is approximately ½" wide. Both conductive surfaces 46, 48 comprising the capacitor 42 are approximately ⅝" wide. The surface 46 coupled to the center contact 50 is approximately 1" long and the surface coupled to the tap point 52 is approximately ¾" long. The actual physical dimensions of these surface are not critical so long as the antenna is resonant for a particular frequency to be used in communications. A dimension A (FIG. 2) between the edge of the substrate 20 and the end of the two conducting surfaces 16, 18 can be varied to tune the antenna for a particular frequency of operation. Thus, for a quarter wave antenna tuned to a frequency of from 490–512 megahertz the dimension A is approximately 1-15/64".

Figure 8:
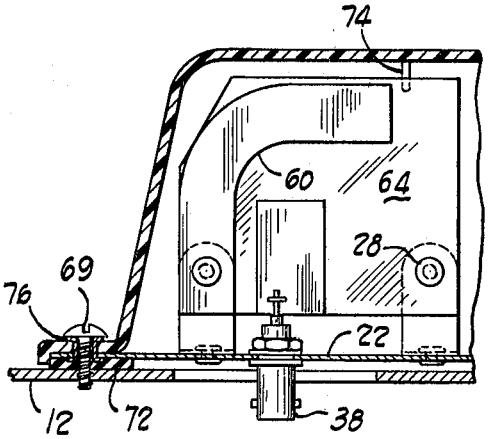
FIGS. 8, 9 and 10 show an antenna which resonates at a different frequency than the antenna shown in FIG. 2.
Figure 9:
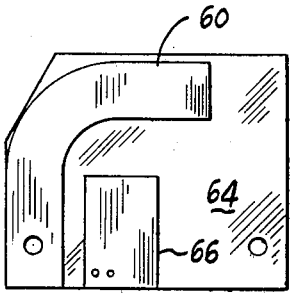
Figure 10:
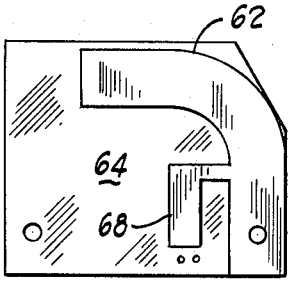

FIGS. 8, 9 and 10 show an antenna made in accordance with this invention and tuned to a frequency of approximately 800 megahertz. As seen in those FIGURES, the antenna has conducting surfaces 60, 62 which are substantially shorter than the conducting surfaces 16, 18 for a smaller frequency antenna. The smaller antenna is mounted to a substrate 64 which is 2 inches wide by 2½ inches long. The width of the surfaces 60, 62 remains approximately ½ inch.

Two conducting surfaces 66, 68 in conjunction with the substrate 64 capacitively couple this alternate design antenna to the connector 38 (FIG. 8). It should be appreciated that the capacitance formed by the conducting surfaces may be varied depending upon the design of the antenna. Where the antenna 10 is designed to be resonant for a frequency of approximately 500 megahertz the combination of the conductive surfaces 46, 48 and substrate 20 is designed to have a capacitance of approximately 1.1 picofarads. For the shorter antenna designed to be resonant in a frequency of approximately 800 megahertz one conductive surfaces 68 is substantially reduced in size to provide a capacitance of approximately 0.55 picofarads.

The housing 11 is transmissive to radio frequency electromagnetic radiation, fits over the antenna 10 and is coupled to the vehicle surface 12 by suitable connectors 69 which extend through the plate 22. In the preferred embodiment of the invention the housing comprises ABS plastic. The housing includes a lip 70 at its outer periphery which bounds the conductive plate 22 and a gasket 72 which separates the plate 22 from the vehicle surface 12. When assembled, the gasket 72 prevents water seepage past the housing to holes which must be drilled in the vehicle surface 12 to receive the connectors 69 and BNC connector 38.

The housing 11 has four integral plastic rib sections 74 which project from an inside surface and define two slots for receiving an upper surface of the substrate 20. These sections 74 prevent undue substrate vibration which potentially could weaken the contact between the center contact 50 and the conductive surface 46.

A preferred technique for coupling the housing 11, plate 22 and gasket 72 to the bus surface 12 is illustrated in FIG. 2. A metal eyelet 76 extends through the housing 11 and metal plate 22 and electrically couples the plate 22 with the connector 69. In the preferred embodiment the connector is a bolt which extends through holes in the bus surface 12 the engage a nut 78 and lock washer 80. To mount the antenna 10 in this preferred technique requires that a bus liner (not shown) be removed from the bus ceiling before the antenna 10 is mounted.

Figure 3:
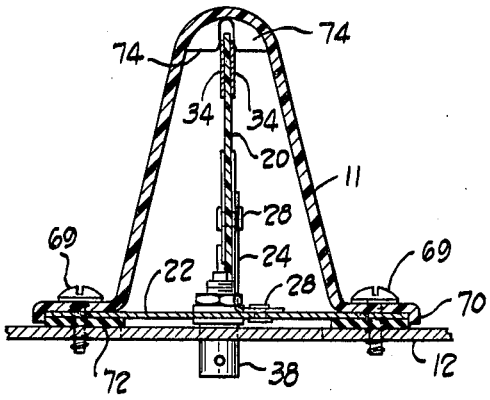
FIG. 3 is a cross sectional view of the antenna taken along line 3—3 in FIG. 2.

An alternate technique for mounting the antenna 10 to the vehicle surface 12 is shown in FIG. 3. According to this embodiment the connectors 69 comprise self tapping screws. This mounting technique avoids the necessity of removing the bus liner from the interior of the bus to mount the antenna 10.

Figure 7:
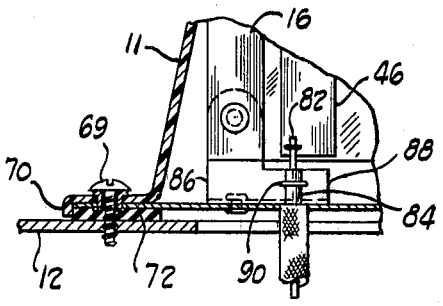
FIG. 7 shows an alternative design for connecting the antenna to a transceiver inside a vehicle.

FIG. 7 shows an alternate connection technique wherein the cable 40 is directly coupled to the antenna and capacitor. A cable center conductor 82 is connected to the conductive surface 46 in a manner identical to the connection between the center contact 50 of the BNC connector. An outer conductor sheath 84 is coupled to the conductive surfaces 16, 18 by a bracket 86 of a slightly different design than the bracket 24 shown in the other FIGS. This bracket 84 defines a leg portion 88 which extends past the outer conductive sheath 84. The leg 88 has two holes drilled through it which are coupled to the outer sheath 84 by a conductor 90 in a manner similar to the way the wire 54 which couples the center contact 50 to the conductive surface 46 (see FIG. 4). Once in place the conductor 82 and sheath 84 are soldered to the surface 46 and leg 78 respectively to complete electrical communication between the transceiver 36 and the antenna.

While a preferred embodiment of the invention has been described with some particularity, it should be appreciated by those skilled in the art that certain design modifications could be incorporated without departing from the spirit or the scope of the invention as defined in the appended claims.

We claim:

1. A mobile communication antenna comprising:

(a) a base at least a portion of which is conductive and adapted to be connected to an associated vehicle for grounding;

(b) an antenna substrate fixed to the base in spaced relationship, the substrate being a relatively thin body of insulating material with its major dimensions positioned longitudinally and transversely of the base;

(c) a housing connected to the base and together with the base defining a protected chamber in which the substrate is positioned, the housing and substrate including interconnected portions which coact to assist in maintaining the substrate in fixed spaced relationship with the base;

(d) two generally L shaped conductive antenna surfaces secured to opposed faces of the substrate;

(e) an electrical connector secured to the base in grounding connection with the conductive portion; and (f) an antenna lead extending through the connector and capacitively connected to at least one of the conductive antenna surfaces.

2. A mobile communication antenna comprising:

(a) a base at least a portion of which is conductive and adapted to be connected to an associated vehicle for grounding;

(b) an antenna substrate fixed to the base, the substrate being a relatively thin body positioned transversely of the base;

(c) a housing connected to the base and together with the base defining a protected chamber in which the substrate is positioned, the housing and substrate including interconnected portions which coact to assist in maintaining the substrate in fixed relationship with the base;

(d) first and second conductive antenna surfaces secured to opposed faces of the substrate;

(e) an electrical connector secured to the base in grounding connection with the conductive portion; and (f) an antenna lead extending through the connector and capacitively connected to at least the first conductive surface.

3. The antenna of claim 2 wherein one of the conductive surfaces is a conductive signal sending and receiving surface forming a dipole having one end conductively grounded to said mounting surface.

4. A mobile communication antenna comprising:

(a) a base at least a portion of which is conductive and adapted to be connected to an associated vehicle for grounding;

(b) an antenna substrate fixed to the base in spaced relationship, the substrate being a relatively thin body of insulating material positioned transversely of the base;

(c) a housing connected to the base and together with the base defining a protected chamber in which the substrate is positioned, the housing and substrate including interconnected portions which coact to assist in maintaining the substrate in fixed spaced relationship with the base;

(d) a first radiation sending and receiving conductive surface attached to said substrate;

(e) a second conductive surface attached to an opposed surface of said substrate; the combination of said substrate, a portion of said first, and said second conductive surfaces forming a capacitor to transmit and receive radio frequency signals to and from said first surface, and (f) a co-axial cable connector having an inner conductor connected conductively to said second surface and an outer sheath contact connected conductively to said first conductive surface and in grounding connection with said base.

5. The apparatus of claim 4 which comprises a third conductive surface in electrical communication with said first surface and mounted to the same substrate surface as said second conductive surface.

6. The apparatus of claim 4 wherein said substrate is substantially rectangular and positioned in an orientation substantially perpendicular to said base and wherein there are two L-shaped conductive signal sending and receiving surfaces affixed in a substantially superimposed relation to opposed surfaces of said substrate one having an end grounded to said mounting surface, an additional conductive surface is also affixed to said substrate to form a single feed capacitor for both sending and receiving surfaces.

* * * * *